US012716312B2

(12) United States Patent
Nafa et al.

(10) Patent No.: US 12,716,312 B2
(45) Date of Patent: Aug. 25, 2026

(54) CONDITIONING A TUBING HEAD BACK PRESSURE VALVE RECEPTACLE

(71) Applicant: Saudi Arabian Oil Company, Dhahran (SA)

(72) Inventors: Hamed Nafa, Juaymah (SA); Mohammed Qethi, Juaymah (SA); Shaker Halawie, Juaymah (SA); Farhan Shammari, Juaymah (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 18/602,446

(22) Filed: Mar. 12, 2024

(65) Prior Publication Data

US 2025/0290382 A1 Sep. 18, 2025

(51) Int. Cl.

| | |
|---|---|
| ***E21B 33/04*** | (2006.01) |
| ***E21B 34/02*** | (2006.01) |
| ***E21B 37/02*** | (2006.01) |

(52) U.S. Cl.

CPC ..... *E21B 33/04* (2013.01); *E21B 34/02* (2013.01); *E21B 37/02* (2013.01)

(58) Field of Classification Search

CPC ..... E21B 33/04; E21B 34/02; E21B 37/00; E21B 37/02

See application file for complete search history.

(56) References Cited

U.S. PATENT DOCUMENTS

| | | | | | |
|---|---|---|---|---|---|
| 2,362,198 | A | * | 11/1944 | Gibson | E21B 37/02 166/173 |
| 2,415,729 | A | * | 2/1947 | Dana | E21B 37/02 134/22.12 |
| 2,671,515 | A | * | 3/1954 | Hall | E21B 37/02 166/173 |
| 3,176,772 | A | * | 4/1965 | Macgregor | E21B 37/02 166/173 |
| 3,815,193 | A | | 6/1974 | Moore | |
| 3,824,646 | A | * | 7/1974 | Jai | B08B 9/045 15/104.095 |

(Continued)

OTHER PUBLICATIONS

Substantive Examination Report Notification issued in Saudi Arabian Application No. 1020251574; Report mail date Mar. 10, 2026; pp. 1-12.

*Primary Examiner* — Aaron L Lembo

(74) *Attorney, Agent, or Firm* — Bracewell LLP; Constance G. Rhebergen; Keith R. Derrington

(57) ABSTRACT

A tool is used for installing and/or operating a back pressure valve mounted in a profile formed in an upper end of a tubing hanger. The tool is also used to remove deposits from the profile by attaching a conditioning module to the tool, and engaging the profile with the module. The module includes a body having a cylindrical mid-portion and frusto-conical upper and lower portions. Brush assemblies circumscribe the body at different elevations along the mid-portion, which remove the deposits on the profile when the module is simultaneously rotated and pressed against the profile. The brush assemblies are made up of sections that each have a base secured to the body and brush elements projecting radially outward from the body. After the deposits are removed, the back pressure valve is installed using the tool.

20 Claims, 9 Drawing Sheets

(56) References Cited

U.S. PATENT DOCUMENTS 4,503,578 A * 3/1985 McIntyre ..... F41A 29/02 15/247
4,515,220 A * 5/1985 Sizer ..... E21B 19/22 166/384
5,002,139 A * 3/1991 Haussmann ..... E21B 17/22 175/323
5,711,046 A * 1/1998 Potter ..... E21B 37/02 166/173
5,819,353 A * 10/1998 Armell ..... E21B 37/02 166/173
5,829,521 A * 11/1998 Brown, Jr. ..... E21B 37/02 166/173
5,839,511 A * 11/1998 Williams ..... E21B 37/00 166/312
6,152,220 A * 11/2000 Carmichael ..... E21B 37/02 166/173
6,209,647 B1 * 4/2001 Brown, Jr. ..... E21B 37/02 166/173
6,401,813 B1 * 6/2002 Carmichael ..... E21B 34/12 166/173
6,460,617 B1 * 10/2002 Allen ..... E21B 33/1204 166/173
6,464,010 B1 * 10/2002 Brown ..... E21B 37/02 166/173
6,530,429 B2 * 3/2003 Howlett ..... E21B 17/1064 166/173
7,513,303 B2 * 4/2009 Hern ..... E21B 37/00 166/99
7,740,073 B2 * 6/2010 Howlett ..... E21B 33/02 166/85.4
8,376,043 B2 * 2/2013 Knobloch ..... E21B 37/02 166/173
8,650,696 B1 * 2/2014 Morales ..... B08B 9/0436 15/104.31
9,134,087 B2 * 9/2015 Canham ..... F41A 29/02
9,221,084 B2 * 12/2015 Palmer ..... B08B 9/045
9,624,757 B2 * 4/2017 Telfer ..... E21B 37/02
9,815,096 B2 * 11/2017 Osaland ..... B08B 9/0436
10,119,368 B2 * 11/2018 Tunget ..... E21B 29/00
10,458,204 B2 * 10/2019 Churchill ..... E21B 37/00
10,815,757 B2 * 10/2020 Osaland ..... E21B 37/02
11,053,769 B2 * 7/2021 Craycraft ..... E21B 34/02
11,319,778 B2 * 5/2022 Howitt ..... E21B 37/02
11,473,404 B2 * 10/2022 Allen ..... B08B 9/0436
12,228,015 B2 * 2/2025 Al-Mousa ..... E21B 33/12
2008/0257541 A1 * 10/2008 Boyd ..... E21B 37/02 166/173
2009/0078404 A1 * 3/2009 Schepp ..... E21B 33/04 166/75.14
2024/0191600 A1 * 6/2024 Karakaya ..... E21B 37/00
2024/0309719 A1 * 9/2024 Karakaya ..... E21B 33/04
2024/0384623 A1 * 11/2024 Baki ..... E21B 34/06
2025/0052132 A1 * 2/2025 Stenshorne ..... E21B 17/01
2025/0109654 A1 * 4/2025 Karakaya ..... E21B 37/06

* cited by examiner 38
34
10
36
26
18
22
32
16
12
20
24
28
30
14

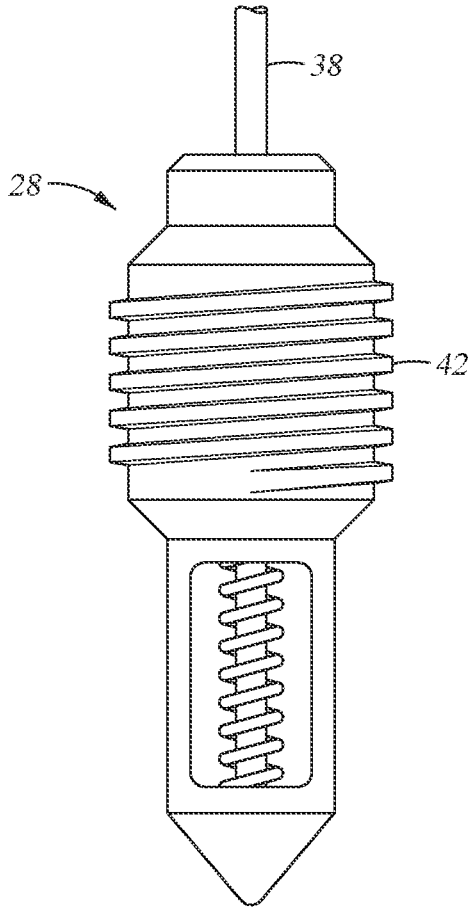
Fig. 2
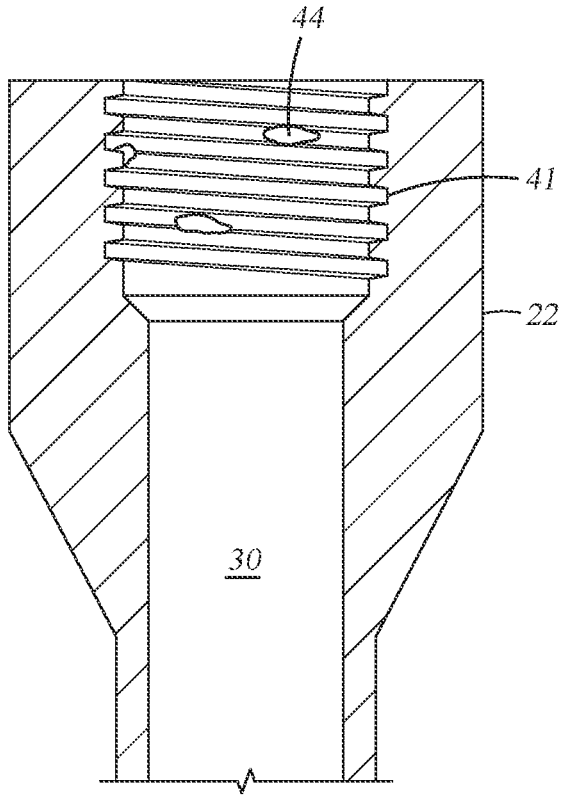

CONDITIONING A TUBING HEAD BACK PRESSURE VALVE RECEPTACLE

BACKGROUND OF THE INVENTION

1. Field of Invention

The present disclosure relates to conditioning a receptacle for a tubing head back pressure valve ("BPV") with a conditioning tool that is deployed on a device used to handle the BPV.

2. Description of Prior Art

Hydrocarbon producing wellbores typically have a wellhead assembly disposed over an entrance to the wellbore for pressure control inside the well, as well as to provide a way for controlled access to the well and means for routing fluid produced from the well to an offsite location. Wells are generally lined with casing, which isolates the wellbore from the surrounding formation. Tubing is inside the casing for directing fluid extracted from the formation to surface. The casing is typically supported within the wellbore by a casing hanger mounted inside a wellhead housing, and a tubing hanger attaches to an inside the casing hanger for supporting the tubing.

Sometimes a back-pressure valve ("BPV") is installed inside an upper end of the tubing hanger for controlling flow through the tubing. The BPV valve usually operates similar to a check valve by blocking fluid inside the tubing from exiting through the upper end of the tubing hanger, and permitting fluid flow into the tubing through the upper end of the tubing hanger. BPVs are mostly utilized for well control purposes and for production tree change outs. BPVs are generally configured to be complementary to a profile in the upper end of the tubing hanger, and often the BPV and profile have corresponding threads that form a threaded connection when the BPV is installed in the profile. The profiles often come into contact with produced hydrocarbons or injected oil water, which can contaminate the profile with deposits of scale or other precipitates. Over time the deposits can interfere with installation of a BPV or cause a BPV to become inoperable, and potentially compromise the ability to maintain pressure control of the well.

SUMMARY OF THE INVENTION

An example of conducting operations in a wellbore is disclosed, which includes using a lubricator assembly to deploy a hanger profile conditioning module into a wellhead assembly that is mounted over the wellbore, manipulating the lubricator assembly so that the hanger profile conditioning module simultaneously rotates and contacts the profile to apply an abrasive force against the profile to remove deposits on the profile, withdrawing the hanger profile conditioning module from the wellhead assembly, and using the lubricator assembly to deploy a back pressure valve into the wellhead assembly. The method optionally includes one or more of manipulating the lubricator assembly to install the back pressure valve in the profile, and using the lubricator assembly to operate the backpressure valve. In an example, the hanger profile conditioning module includes a body circumscribed by a brush assembly, in alternatives, the brush assembly has sections that each circumscribe a portion of the body. In some examples there are many brush assemblies each with sections circumscribing a portion of the body, further optionally in these examples the hanger profile conditioning module is assembled by mounting the sections to the body with pins that insert into passages formed radially through each section and into apertures in the body that register with the passages. In an embodiment, the method further includes moving the hanger profile conditioning module axially with respect to the profile at the same time the hanger profile conditioning module is in rotating contact with the profile.

Another method of conducting operations in a wellbore is disclosed herein and that includes attaching a conditioning module to a rod of a lubricator assembly, deploying the conditioning module into a wellhead assembly that is mounted over the wellbore, manipulating the rod to position the conditioning module into contact with a profile formed in a tubing hanger in the wellhead assembly, removing deposits on the profile by rotating the rod while the hanger profile conditioning module is in contact with the profile, withdrawing the hanger profile conditioning module from the wellhead assembly, obtaining a back pressure valve configured for installation in the profile, and replacing the conditioning module on the lubricator assembly with the back pressure valve. In embodiments the rod is rotated manually, hydraulically, or by both means. The lubricator assembly is optionally used to deploy the back pressure valve into the wellhead assembly, a install the back pressure valve into the profile, or operate the back pressure valve. Alternatives exist in which the conditioning module has a body circumscribed by brush assemblies, the body is made up of frusto-conical upper and lower portions and a cylindrical middle portion, the brush assemblies are sectional members that mount in grooves that circumscribe the middle portion, diameters of the brush assemblies exceed a diameter of the lower portion, or combinations thereof.

BRIEF DESCRIPTION OF DRAWINGS

Some of the features and benefits of the present invention having been stated, others will become apparent as the description proceeds when taken in conjunction with the accompanying drawings, in which:

FIG. 2 is a side partial sectional view of an example of the BPV of FIG. 2 spaced outside of the profile in the tubing hanger.

Figure 1:
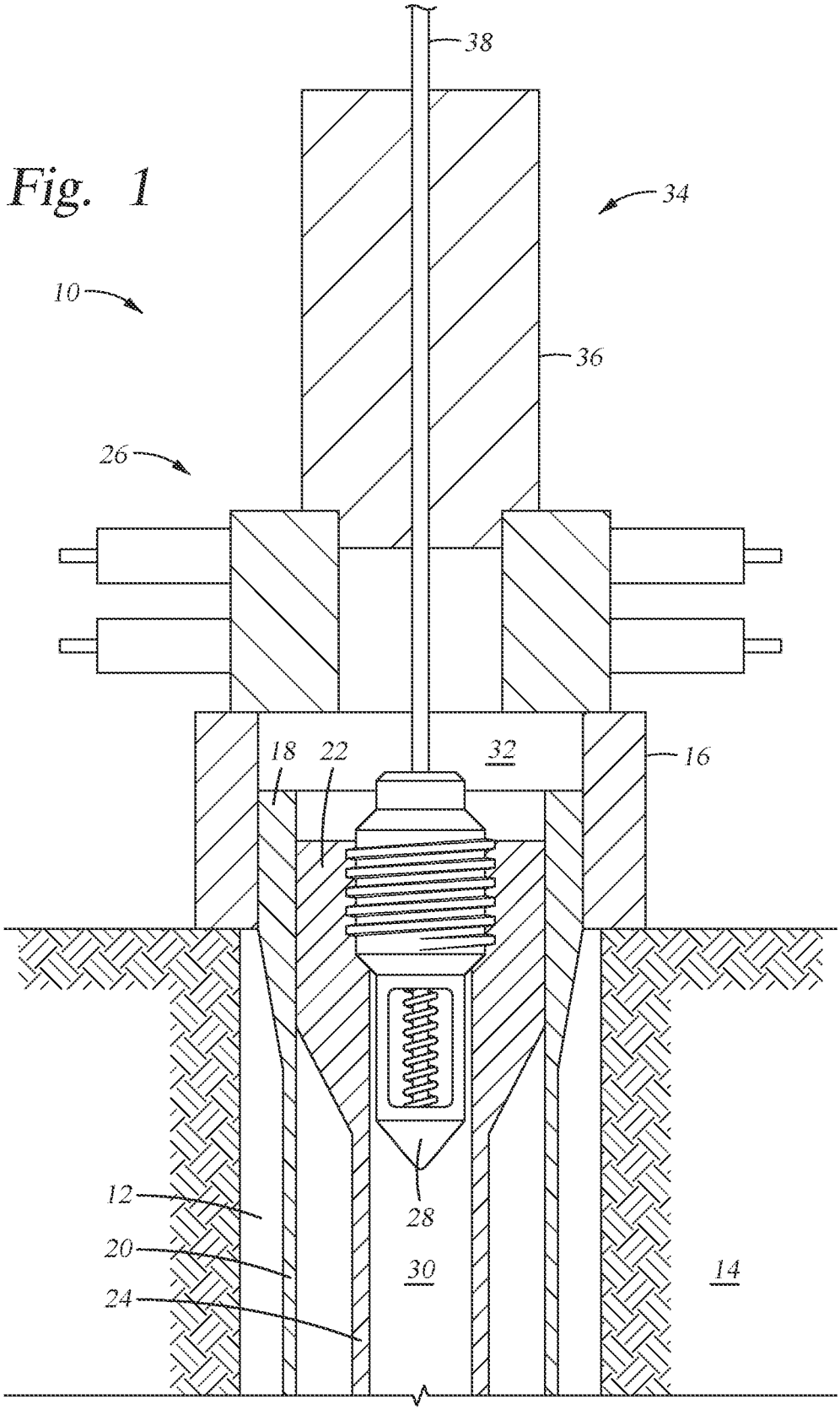
FIG. 1 is a side partial sectional view of an example of a wellhead assembly having a back pressure valve ("BPV") in a profile of a tubing hanger.

While subject matter is described in connection with embodiments disclosed herein, it will be understood that the scope of the present disclosure is not limited to any particular embodiment. On the contrary, it is intended to cover all alternatives, modifications, and equivalents thereof.

DETAILED DESCRIPTION OF INVENTION

The method and system of the present disclosure will now be described more fully hereinafter with reference to the accompanying drawings in which embodiments are shown. The method and system of the present disclosure may be in many different forms and should not be construed as limited to the illustrated embodiments set forth herein; rather, these embodiments are provided so that this disclosure will be thorough and complete, and will fully convey its scope to those skilled in the art. Like numbers refer to like elements throughout. In an embodiment, usage of the term "about" includes +/−5% of a cited magnitude. In an embodiment, the term "substantially" includes +/−5% of a cited magnitude, comparison, or description. In an embodiment, usage of the term "generally" includes +/−10% of a cited magnitude.

It is to be further understood that the scope of the present disclosure is not limited to the exact details of construction, operation, exact materials, or embodiments shown and described, as modifications and equivalents will be apparent to one skilled in the art. In the drawings and specification, there have been disclosed illustrative embodiments and, although specific terms are employed, they are used in a generic and descriptive sense only and not for the purpose of limitation.

In FIG. 1 an example of a wellhead assembly 10 is shown in a side partial sectional view. Assembly 10 is mounted over a wellbore 12 that intersects a formation 14. A wellhead housing 16 is included with the wellhead assembly 10, and a casing hanger 18 is mounted inside of the wellhead housing 16. The casing hanger 18 supports a length of casing 20, shown extending into the wellbore 12. Within the casing hanger 18 is a tubing hanger 22, which supports a string of production tubing 24 shown depending into the wellbore 12 within casing 20. A blowout preventer 26 is illustrated mounted on wellhead housing 16. A back pressure valve ("BPV") 28 is illustrated inserted into an upper end of the tubing hanger 22, which is selectively installed to control pressure inside tubing 24, and to prevent communication of fluid from within a bore 30 of tubing 24 into a main bore 32 of wellhead assembly 10, while permitting fluid flow from main bore 32 into tubing hanger 22 and bore 30. In the example shown, a lubricator assembly 34 is used for installing the BPV 28. As schematically shown, lubricator assembly 34 includes a housing 36 and a rod 38 that extends axially through housing 36. Seals (not shown) within housing 36 seal against rod 38 and form a barrier to block fluid communication from within housing 36 to ambient. In examples, rod 38 is selectively used for operation of BPV 28 as needed.

In FIG. 2, shown in greater detail is a side sectional view of deploying BPV 28 into tubing hanger 22. In the example shown, threads 40 are provided in a profile 41 configured at an uppermost end of tubing hanger 22. Corresponding threads 42 are formed on an outer surface of BPV 28, so that engaging threads 40 with threads 42 forms a threaded connection between BPV 28 to tubing hanger 22. By engaging the threads 40, 42 into contact with one another along a designated percentage of their respective lengths, sealing surfaces (not shown) on the BPV 28 and tubing hanger 22 are brought into sealing contact. Further illustrated in FIG. 2 are deposits 44 formed on the threads 40, examples of deposits 44 include scale, oxidation, corrosion, particulate matter, and other detritus. In examples, the deposits 44 impede engaging the threads 40, 42 by the amount to obtain sealing contact, which poses a hazard of allowing pressurized fluid in the bore 30 to communicate into the main bore 32.

Figure 3A:
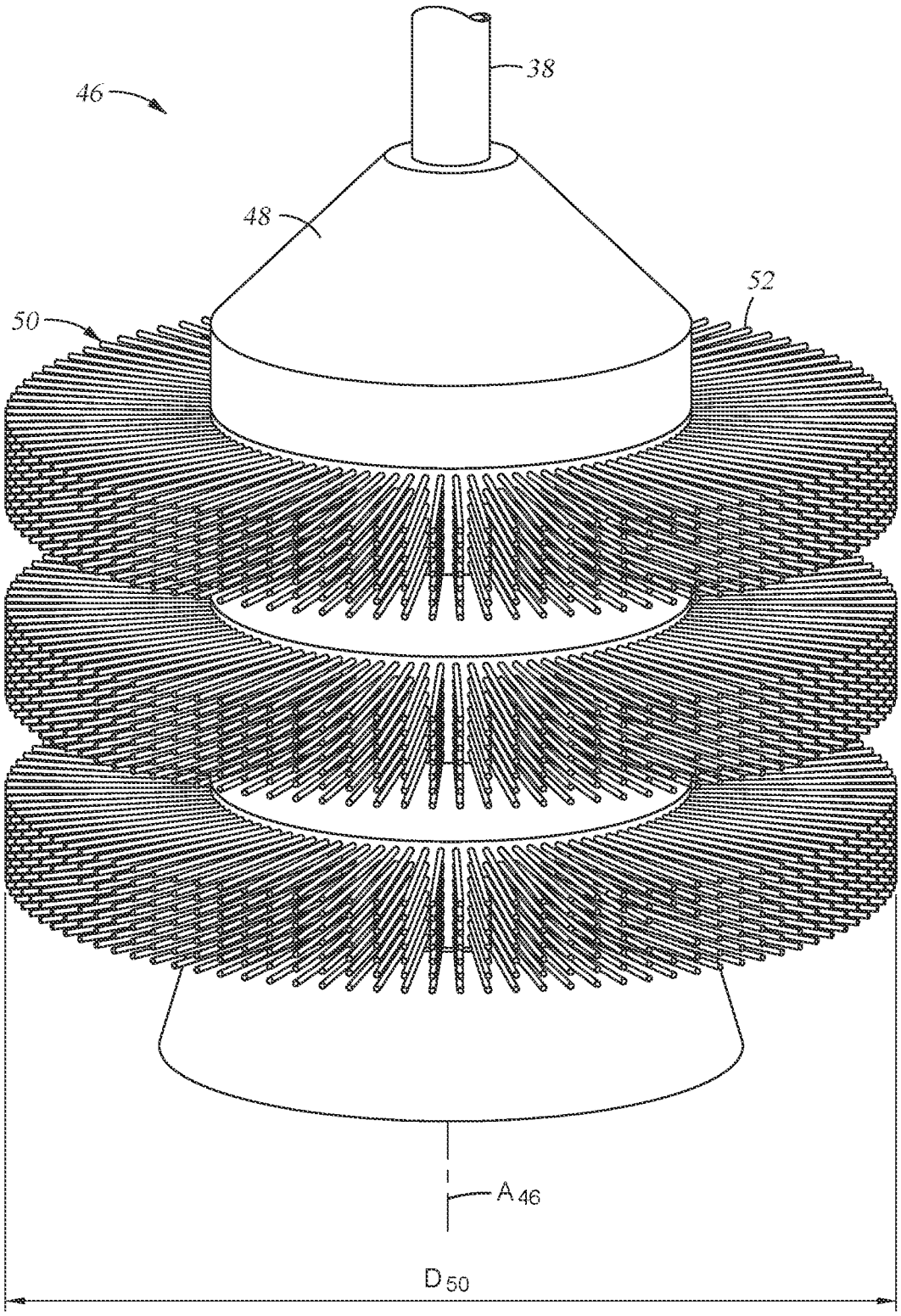
FIG. 3A is an elevational view of an example of a hanger profile conditioning module.
Figure 3B:
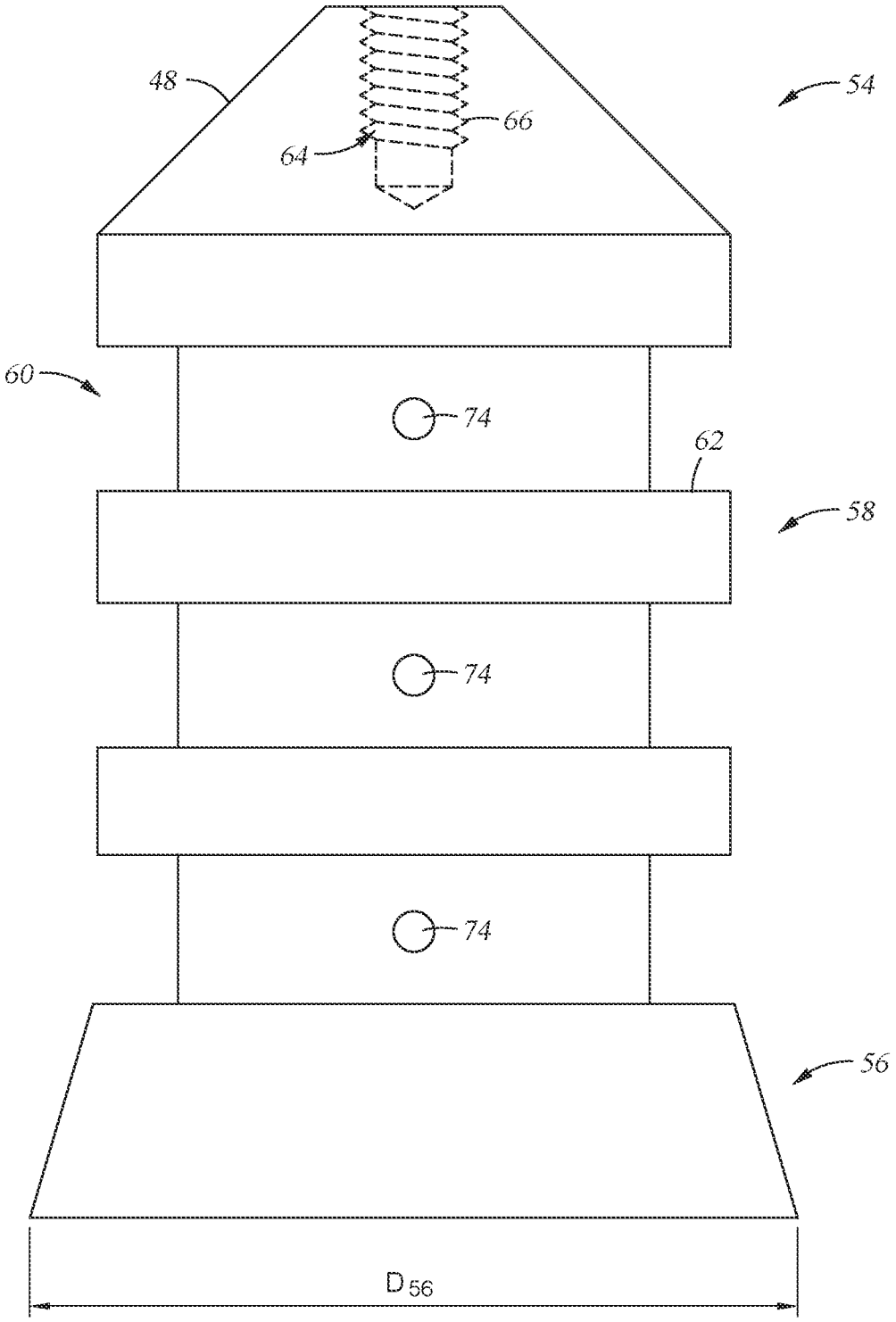
FIGS. 3B and 3C are side and plan views of portions of the module of FIG. 3A.
Figure 3C:
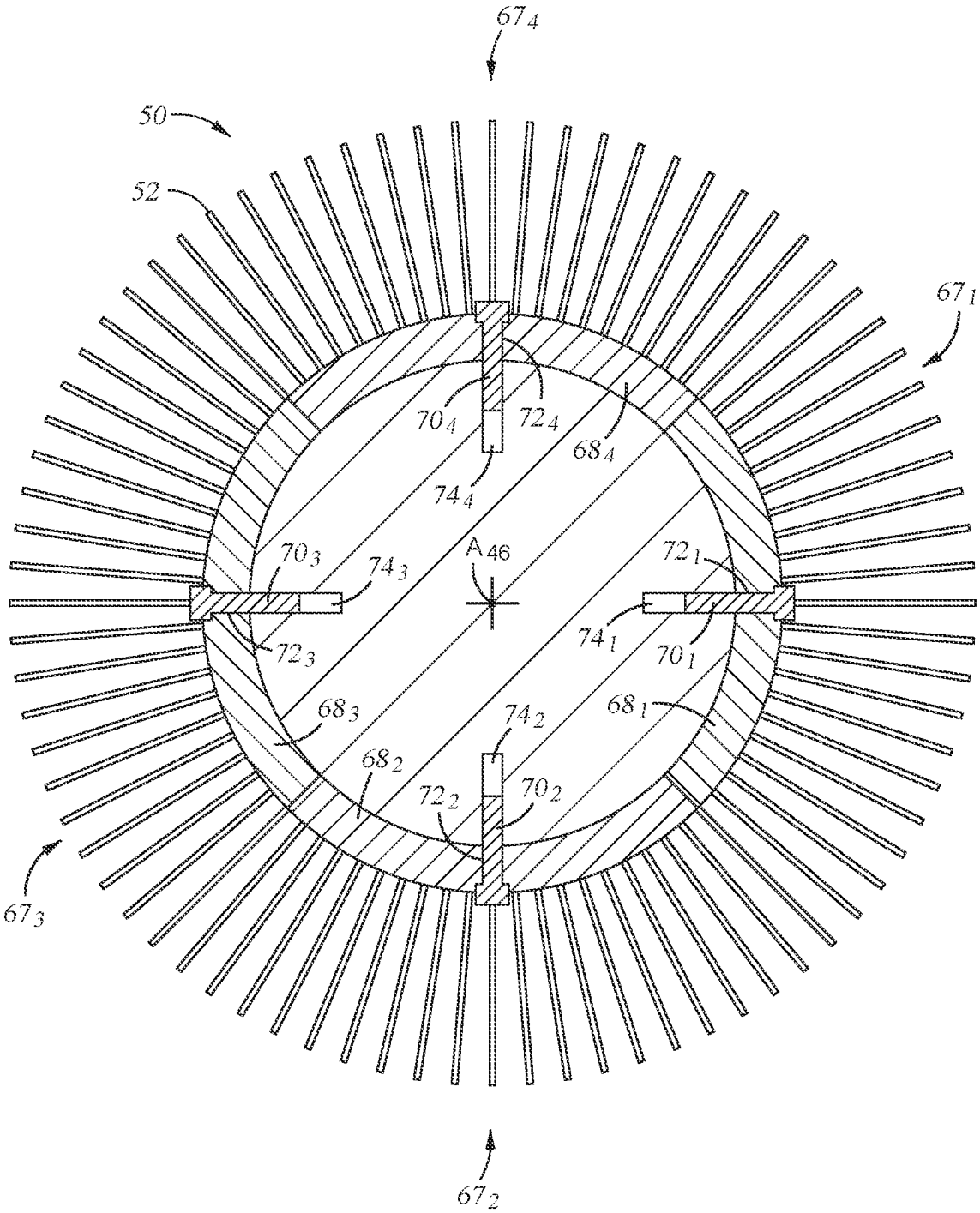

Referring now to FIGS. 3A-3C, shown in elevational and plan views is an example of a hanger profile conditioning module 46 for removing the deposits 44 (FIG. 2). As depicted in FIG. 3A, the conditioning module 46 includes a body 48 with brush assemblies 50 mounted thereon. The brush assemblies 50 are shown circumscribing a portion of body 48 and spaced apart from one another along axis $A_{46}$. Each of the brush assemblies 50 include a plurality of brush elements 52 that extend radially outward from axis $A_{46}$. In embodiments, the brush elements 52 are non-uniform in shape and spacing from one another, and are alternatively formed from varying types of material. In examples, the material of the elements 52 include soft carbon steel. In a side view in FIG. 3B shown is the body 48 without the brush assemblies 50 of FIG. 3A. As illustrated, body 50 includes upper and lower portions 54, 56, which are each frusto-conically shaped and oriented so that their respective diameters reduce along axis $A_{46}$ in a direction from the lower portion 56 to the upper portion 54. The lower portion 56 slope is shaped to assist in removing scale from inside the tubing 24. Between the upper and lower portions 54, 56 of body 48 is a middle portion 58 that in the example shown is substantially cylindrical, recesses 60 are formed along an outer surface of middle portion 58, which circumscribe axis $A_{46}$. Recesses 60 are spaced axially apart from one another to define ring-like shoulders 62 between adjacent recesses 60, shoulders 62 provide lateral support for the brush assemblies 50. Formed axially into an upper end of the upper portion 54 is a receptacle 64 for receiving a lower end of rod 38. Optional threads 66 are shown in dashed outline formed within the receptacle 64. In FIG. 3C is an overhead view of brush assemblies 50, in the example shown each of the brush assemblies 50 is made up of segments $\mathbf{67}_{1\text{-}4}$ that each include a base section $\mathbf{68}_{1\text{-}4}$. Each base section $\mathbf{68}_{1\text{-}4}$ is a substantially solid member and provides a substrate in which the brush elements 52 are mounted. Each of the base sections $\mathbf{68}_{1\text{-}4}$ are semicircular and in the example shown span roughly 90° round axis $A_{46}$. Pins $\mathbf{70}_{1\text{-}4}$ are schematically shown spaced radially outward from segments $\mathbf{67}_{1\text{-}4}$. Referring back to FIG. 3B, in a non-limiting example, brush assembly 50 is formed by positioning each of the segments $\mathbf{67}_{1\text{-}4}$ so that their respective base sections $\mathbf{68}_{1\text{-}4}$ are within one of the recesses 60, registering the passages $\mathbf{72}_{1\text{-}4}$ with one of the apertures 74 shown formed radially into the middle portion 58 inside the recesses 60, and the pins $\mathbf{70}_{1\text{-}4}$ are inserted into passages $\mathbf{72}_{1\text{-}4}$ a distance so that their inner radial ends project into a registered aperture 74; which secures sections $\mathbf{68}_{1\text{-}4}$ to the body 48. An advantage of forming a brush assembly 50 with sections $\mathbf{68}_{1\text{-}4}$ that are installed with insertion of pins $\mathbf{70}_{1\text{-}4}$ enables ready replacement of the sections $\mathbf{68}_{1\text{-}4}$, and facilitates substitution of sections $\mathbf{68}_{1\text{-}4}$ with different sections (not shown) with different configurations or characteristics.

Figure 4:
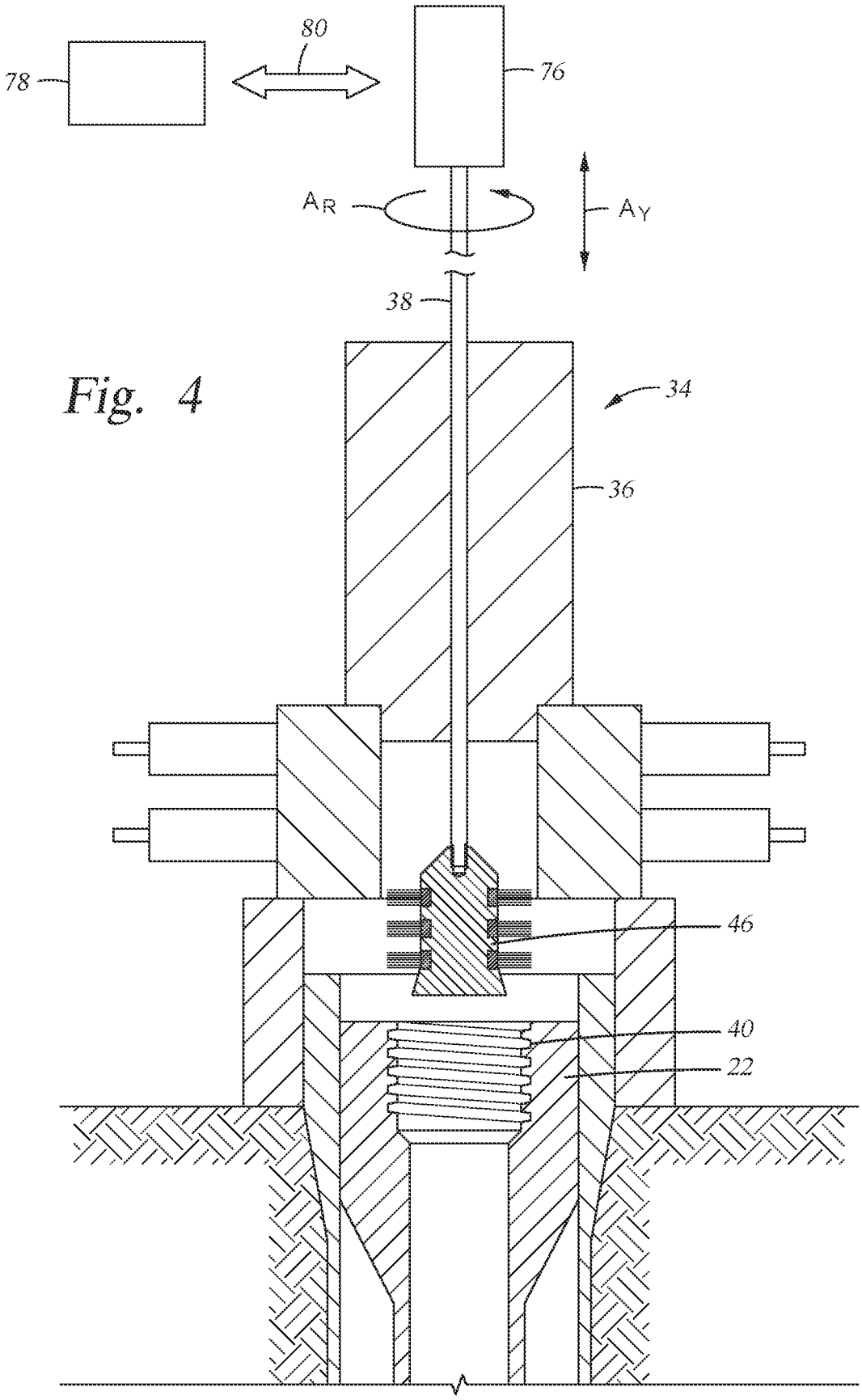
FIG. 4 is a side partial sectional view of an example of deploying the module of FIG. 3A inside of a wellhead assembly.

In FIG. 4 is a side partial sectional view of an example of using the lubricator assembly 34 to deploy the conditioning module 46 into the wellhead assembly 10. In the example shown is when the well is live, with housing 36 mounted on wellhead assembly 24 and conditioning module 46 is attached to an end of rod 38, manipulating the rod 38 moves the module 46 into the upper end of the tubing hanger 22. In an alternative, an actuator 76 is included that is mounted to an end of the rod 38 opposite the conditioning module 46. As illustrated by the curved and axial arrows, movement of the rod 38 upwards and downwards for in a rotating motion is provided by operation of the actuator 76. In examples, actuator 76 is powered by one or more of hydraulics or electricity. In alternatives, the rod 38 is manipulated manually to move the rod up and down or rotate the rod. Optionally, a controller 78 is shown for providing control commands to actuator 76 via communication means 80. Examples of communication include hard-wired, fiber optics, and wireless.

Figure 5:
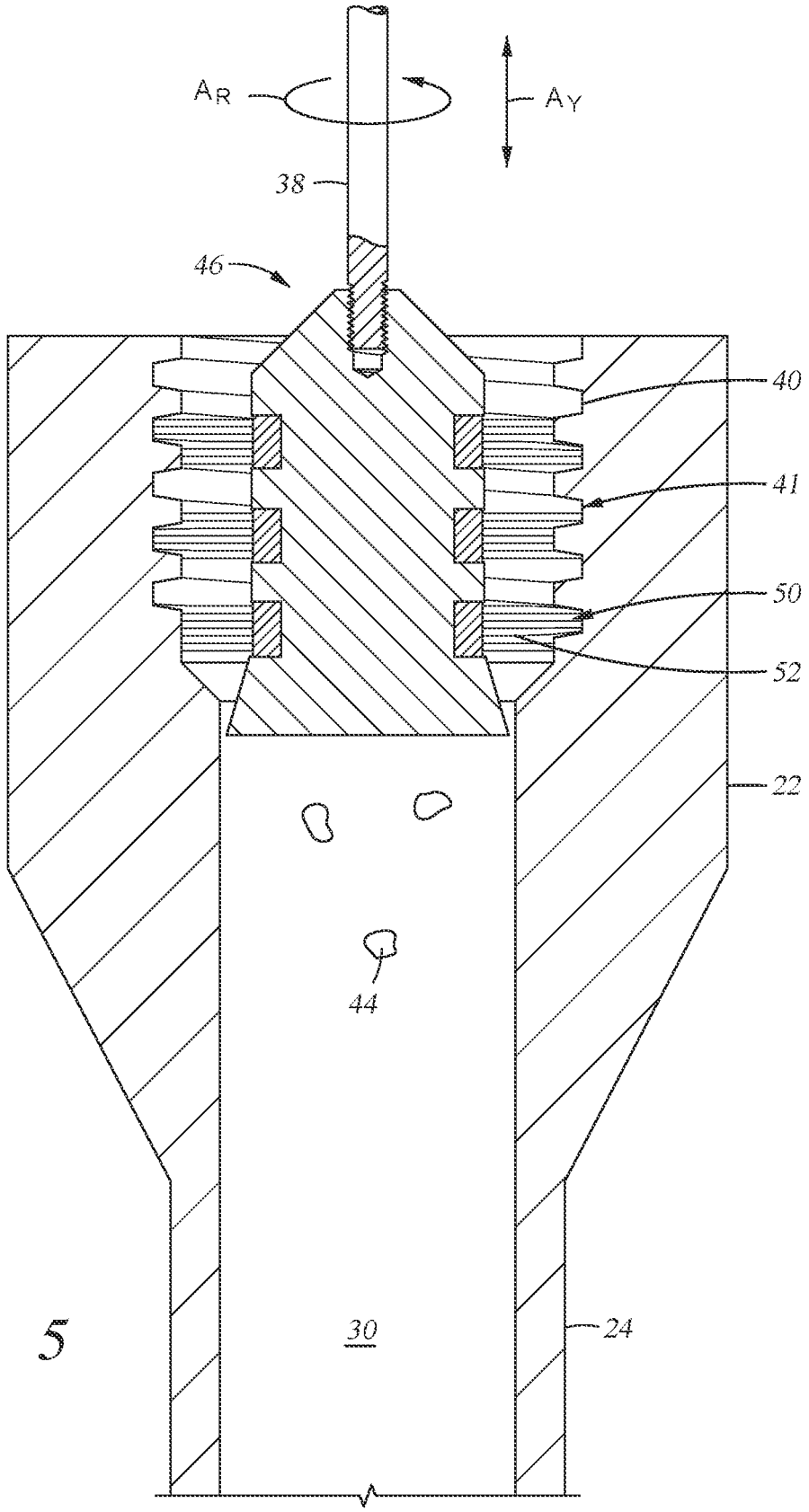
FIG. 5 is a side partial sectional view of an example of conditioning the profile of FIG. 2 with the module of FIG. 3A.

A more detailed view of engaging the profile 41 with the conditioning module 46 is shown in a side partial section view in FIG. 5. As shown, brush elements 52 on the brush assemblies 50 are in contact with the threads 40 on the profile 41; and as indicated by arrows $A_Y$ and $A_R$, the conditioning module 46 is being axially reciprocated while simultaneously being rotated. This action, coupled with the outer profile of the module 46 that is shaped complementary to the inner bore of the tubing 24, provides an abrasive force onto the threads 40 to dislodge the deposits 44. As shown, the deposits 44 drop downhole inside the bore 30 of the tubing 24 after being removed from the profile 41. By removing the deposits from within the profile 41, a sealing contact between the BPV 28 (FIG. 2) can be obtained by installing the BPV 28 with the lubricator assembly 34. In an alternative, and when well is not live and pressure in well is substantially equal to ambient pressure, a T-bar with a connected polish rod (not shown) is used to manually perform the action described in this figure.

Figure 6A:
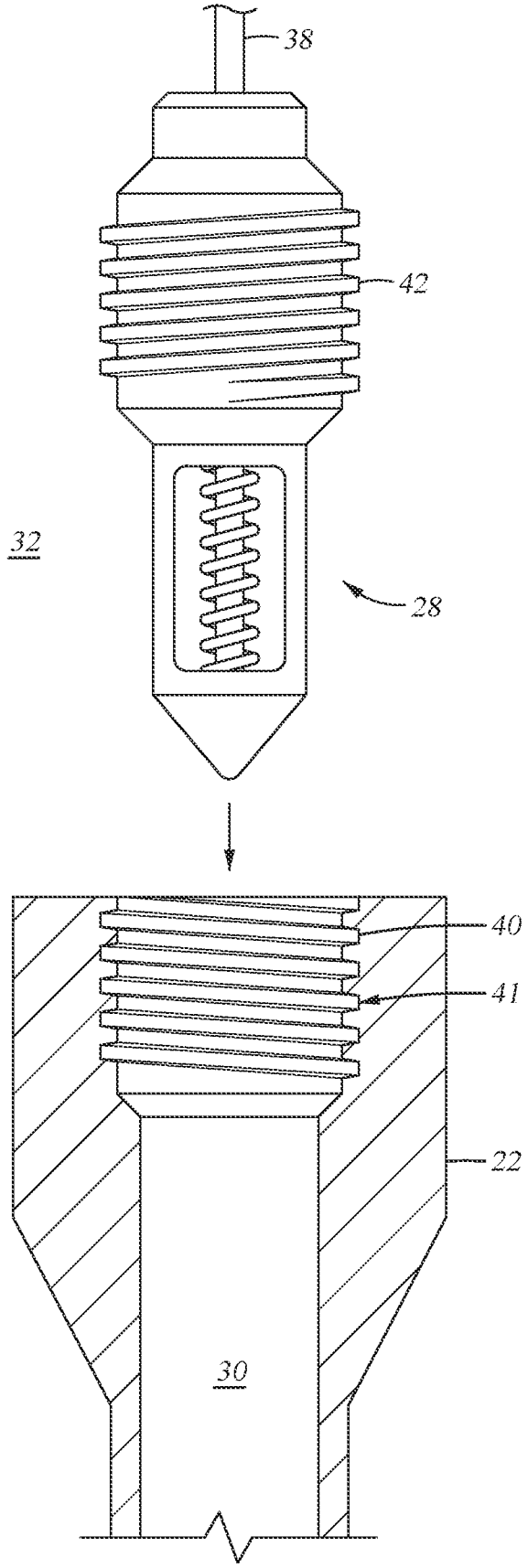
FIGS. 6A and 6B are side partial sectional views of installing a BPV in a conditioned tubing hanger.
Figure 6B:
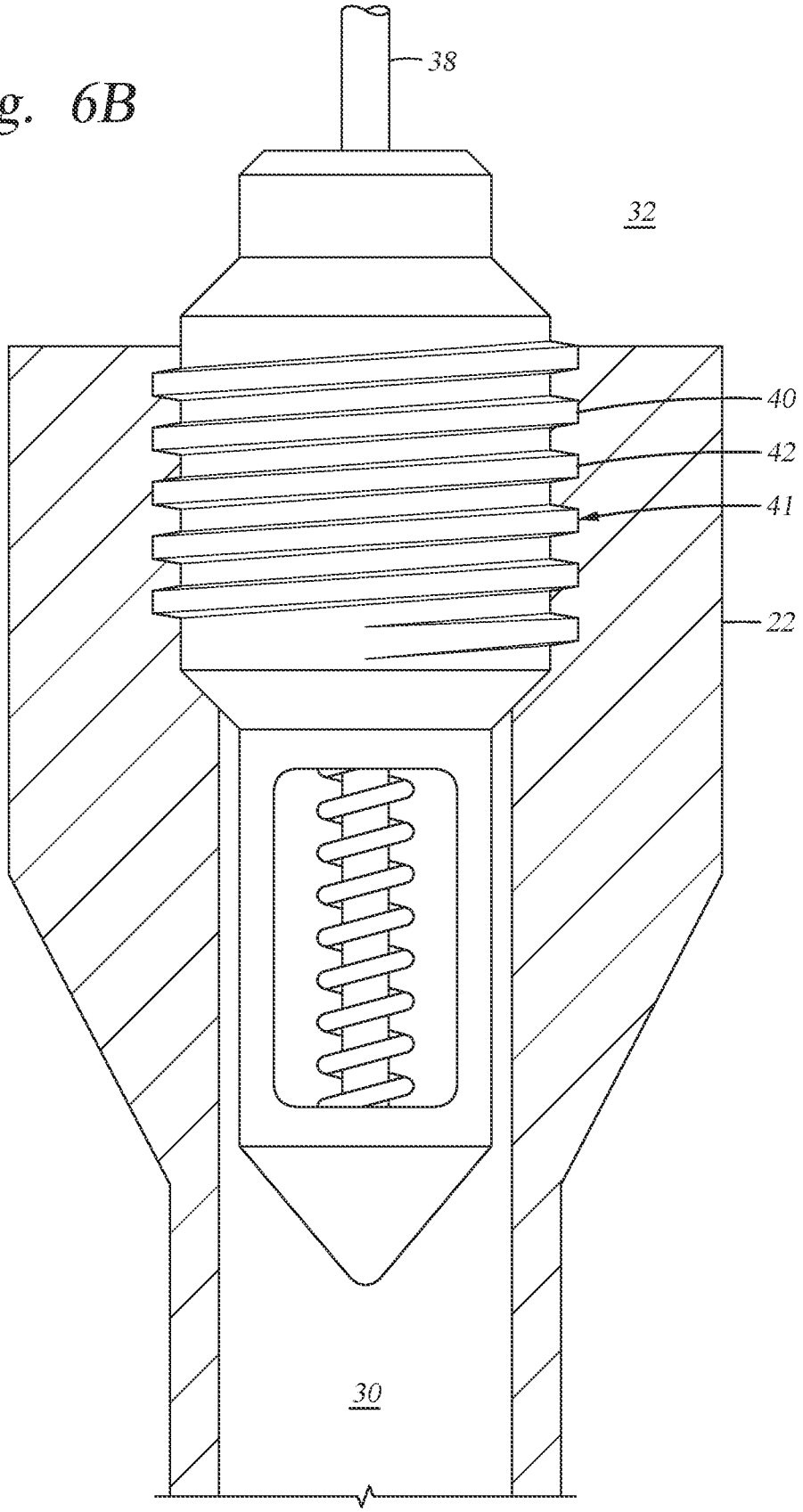

In a non-limiting example of operation, wellhead assembly 10 (FIG. 1) is operated without BPV 28 installed in tubing hanger 22, so that fluid from formation 14 flows uphole inside bore 30, and across profile 41 (FIG. 2) unimpeded into main bore 32. Which in examples and over time results in deposits 44 forming along profile 41. As shown in FIGS. 6A and 6B, the deposits 44 have been removed, such as with the hanger profile conditioning module 46 as disclosed above. With the profile 41 being clear of deposits 44, the BPV 28 is shown being lowered downward through main bore 32 on an end of rod 38. By manipulating the lubricator assembly 34, the BPV 28 is being inserted into an opening of the bore 30 at the upper end of the tubing hanger 22. Referring to FIG. 6B, BPV 28 is shown inserted into the opening of bore 30 and threads 42 on the BPV 28 are engaged with threads 40 along profile 41 to form a threaded connection. The engagement of the threads 40, 42 is not impeded by the presence of deposits 44 or other foreign matter, so that the sealing surfaces (not shown) are engaged and form a sealing interface I along profile to isolate main bore 32 from bore 30.

The present invention described herein, therefore, is well adapted to carry out the objects and attain the ends and advantages mentioned, as well as others inherent therein. While a presently preferred embodiment of the invention has been given for purposes of disclosure, numerous changes exist in the details of procedures for accomplishing the desired results. In examples in which threads 40 (FIG. 2), such as due to cross threading or being impacted by a harder material, the threads 40 are repaired or "dressed" by a tap (not shown) that is attached to the rod 38 (FIG. 1). These and other similar modifications will readily suggest themselves to those skilled in the art, and are intended to be encompassed within the spirit of the present invention disclosed herein and the scope of the appended claims.

What is claimed is:

1. A method of wellbore operations comprising:

using a lubricator assembly to deploy a hanger profile conditioning module into a wellhead assembly that is mounted over the wellbore;

manipulating the lubricator assembly so that the hanger profile conditioning module simultaneously rotates and contacts a profile in the wellhead assembly to apply an abrasive force against the profile to remove deposits on the profile;

withdrawing the hanger profile conditioning module from the wellhead assembly; and using the lubricator assembly to deploy a back pressure valve into the wellhead assembly.

2. The method of claim 1, further comprising manipulating the lubricator assembly to install the back pressure valve in the profile.

3. The method of claim 2, wherein the hanger profile is formed on a tubing hanger that supports a string of production tubing in the wellbore, the method further comprising using the lubricator assembly to operate the backpressure valve so that the backpressure valve blocks fluid inside the production tubing from exiting through an upper end of the tubing hanger and permitting fluid flow into the production tubing through the upper end of the tubing hanger.

4. The method of claim 1, wherein the lubricator assembly comprises a housing, a rod having a first end, and an actuator connected to a second end of the rod that is opposite the first end, the rod extending axially through the housing, wherein the first end is connected to the hanger profile conditioning module when the hanger profile conditioning module is being deployed into the wellhead assembly, when the hanger profile conditioning module is being rotated, and when the hanger profile conditioning module is being withdrawn from the wellhead assembly, and wherein the first end is connected to the back pressure valve when the back pressure valve is being installed in the wellhead assembly.

5. The method of claim 1, wherein the hanger profile conditioning module comprises a body circumscribed by a brush assembly and wherein the brush assembly comprises sections that each circumscribe a portion of the body.

6. The method of claim 5, wherein the brush assembly comprises a first brush assembly and wherein the hanger profile conditioning module comprises a plurality of brush assemblies that each comprise sections circumscribing a portion of the body, the method further comprising assembling the hanger profile conditioning module by mounting the sections to the body with pins that insert into passages formed radially through each section and into apertures in the body that register with the passages.

7. The method of claim 1, further comprising moving the hanger profile conditioning module axially with respect to the profile at the same time the hanger profile conditioning module is in rotating contact with the profile.

8. A method of wellbore operations comprising:

attaching a conditioning module to a rod of a lubricator assembly;

deploying the conditioning module into a wellhead assembly that is mounted over the wellbore;

manipulating the rod to position the conditioning module into contact with a profile formed in a tubing hanger in the wellhead assembly;

removing deposits on the profile by rotating the rod while the hanger profile conditioning module is in contact with the profile;

withdrawing the hanger profile conditioning module from the wellhead assembly;

obtaining a back pressure valve configured for installation in the profile;

replacing the conditioning module on the rod with the back pressure valve; and lowering the back pressure valve through the wellhead assembly on the end of the rod for installation in the tubing hanger.

9. The method of claim 8, wherein the rod is manually rotated.

10. The method of claim 8, wherein a hydraulic force is applied to rotate the rod.

11. The method of claim 8, further comprising using the lubricator assembly to deploy the back pressure valve into the wellhead assembly, wherein the conditioning module is attached to a first end of the rod, wherein an actuator is connected to a second end of the rod that is opposite the first end, wherein the first end is connected to the conditioning module when the conditioning module is being deployed into the wellhead assembly, when the conditioning module is being rotated, and when the conditioning module is being withdrawn from the wellhead assembly, and wherein the first end is connected to the back pressure valve when the back pressure valve is being installed in the wellhead assembly.

12. The method of claim 11, further comprising using the lubricator assembly to install the back pressure valve into the profile.

13. The method of claim 12, further comprising using the rod to operate the back pressure valve so that the backpressure valve blocks fluid inside the production tubing from exiting through an upper end of the tubing hanger and permitting fluid flow into the production tubing through the upper end of the tubing hanger.

14. The method of claim 8, wherein the conditioning module comprises a body circumscribed by brush assemblies.

15. The method of claim 14, wherein the body comprises frusto-conical upper and lower portions, and a cylindrical middle portion.

16. The method of claim 15, wherein the brush assemblies are sectional members that mount in grooves that circumscribe the middle portion.

17. The method of claim 15, where diameters of the brush assemblies exceed a diameter of the lower portion.

18. A system for use in a wellbore comprising:

a lubricator assembly selectively attached to a wellhead assembly that is mounted over the wellbore;

an actuator;

a rod having an upper end attached to the actuator and a portion axially reciprocating and rotating into the lubricator assembly in response to operation of the actuator; and a hanger profile conditioning module attached to lower end of the rod inside the lubricator, so that when the rod axially reciprocates and rotates the hanger profile conditioning module rotates and contacts and exerts an abrasive force against a profile in the wellhead assembly to remove deposits on the profile, the profile having threads configured for threading attachment of a back pressure valve.

19. The system of claim 18, wherein the hanger profile conditioning module comprises a body and a plurality of brush assemblies that each comprise sections circumscribing a portion of the body and that each have radial passages that selectively receive pins, and wherein ends of the pins insert into apertures in the body that register with the passages.

20. The system of claim 18, wherein the end of the rod comprises threads and the hanger profile conditioning module is selectively replaceable on the end of the rod with a backpressure valve.

* * * * *